US005442379A

United States Patent [19]

Bruce et al.

[11] Patent Number: 5,442,379

[45] Date of Patent: Aug. 15, 1995

[54] HIGH SPEED RAMDAC WITH RECONFIGURABLE COLOR PALETTE

[75] Inventors: Robert A. Bruce, Portland; Albert Xthona, Yamhill; Dan Moss, Aloha, all of Oreg.

[73] Assignee: Metheus Corporation, Beaverton, Oreg.

[21] Appl. No.: 92,033

[22] Filed: Jul. 15, 1993

Related U.S. Application Data

[63] Continuation of Ser. No. 747,197, Aug. 15, 1991, abandoned.

[51] Int. Cl.[6] ..... G09G 1/28

[52] U.S. Cl. ..... 345/199; 345/153

[58] Field of Search ..... 345/132, 153, 188, 202, 345/150, 203, 199, 200; 307/355; 370/58, 243; 455/4.2; 358/80

[56] References Cited

U.S. PATENT DOCUMENTS

| | | | |
|---|---|---|---|
| 2,345,048 | 3/1944 | Hubbard et al. | 370/53 |
| 3,638,040 | 1/1972 | Mahmoud | 307/243 |
| 3,806,814 | 4/1974 | Forbes | 455/4.2 |
| 4,214,177 | 7/1980 | Raggenbass et al. | 307/355 |
| 4,524,421 | 6/1985 | Searby et al. | 340/703 |
| 4,546,451 | 10/1985 | Bruce . | |
| 4,704,605 | 11/1987 | Edelson . | |
| 4,815,033 | 3/1989 | Harris . | |
| 4,818,979 | 4/1989 | Manson | 340/703 |
| 4,829,291 | 5/1989 | Elgood et al. | 340/703 |
| 4,853,681 | 8/1989 | Takashima | 340/703 |
| 5,075,767 | 12/1991 | Takaragi | 358/80 |

OTHER PUBLICATIONS

Brooktree Product Databook 1991, Third Edition, p. 4–327.

Continuous Edge Graphics in A VGA System, Edsun Corp., 12 pages.

INMOS Data Sheet for IMS G300B Colour Video Controller.

Sierra Semiconductor SC11485/SC11489 Data sheet, 1989, 16 pages.

Computer Graphics, Principles and Practice, J. D. Foley et al., Second Edition, Addison–Wesley Publishing Co., pp. 166–170.

Mini–Circuits GaAs SPDT Switch Data Sheet.

Metheus Corporation 5700 Series Display Controllers Data sheet.

*Primary Examiner*—Tommy P. Chin

*Assistant Examiner*—Gin Goon

*Attorney, Agent, or Firm*—Marger, Johnson, McCollom & Stolowitz

[57] ABSTRACT

A method and apparatus for generating both a true color and fast pseudo color video signals includes the combination of first and second commercially available RAMDACs. Parallel video data representing the red, blue, and green color components of one or more pixels is provided on a video bus to the inputs of the first and second RAMDACs. A first data portion of the parallel video data is presented to the input of the first RAMDAC, which can represent either a single pixel in the fast pseudo color mode or the most significant pixel data. A second data portion of the parallel video data is presented to the input of the second RAMDAC, which can represent either another single pixel in the fast pseudo color mode or the least significant pixel data. The outputs of the two RAMDACs are combined to provide true color video signals in a first RAM programming mode, and the respective outputs of the two RAMDACs are multiplexed to provide fast pseudo color video signals in a second RAM programing mode.

19 Claims, 10 Drawing Sheets

HIGH SPEED LOOKUP MODE

| | SW1 | SW2 | SW3 | SW4 | SW5 | SW6 |
|---|---|---|---|---|---|---|
| CLOCK HI | ON | ON | ON | OFF | OFF | OFF |
| CLOCK LOW | OFF | OFF | OFF | ON | ON | ON |

TYPICAL TRUE COLOR MODE

| SW1 | SW2 | SW3 | SW4 | SW5 | SW6 |
|---|---|---|---|---|---|
| OFF | ON | ON | ON | ON | OFF |

Fig. 8

| R | G | B |
|---|---|---|
| 6 | 4 | 6 |
| 4 | 4 | 8 |
| 5 | 3 | 8 |
| 5 | 4 | 7 |
| 5 | 5 | 6 |

| R | B1 | B2 | B |
|---|---|---|---|
| 6 | 2 | 2 | 6 |
| 4 | 4 | 0 | 8 |
| 5 | 3 | 0 | 8 |
| 5 | 3 | 1 | 7 |
| 5 | 3 | 2 | 6 |

| R | G | B |
|---|---|---|
| 6 | 4 | 6 |
| 5 | 5 | 5 |

| R | G1 | G2 | B |
|---|---|---|---|
| 6 | 2 | 2 | 6 |
| 5 | 3 | 2 | 5 |

Fig. 9

HIGH SPEED RAMDAC WITH RECONFIGURABLE COLOR PALETTE

This is a continuation of application Ser. No. 07/747,197, filed Aug. 15, 1991, now abandoned.

BACKGROUND OF THE INVENTION

This invention pertains to color video graphics, and more particularly to a high speed RAMDAC circuit capable of providing both a true color mode and a high speed pseudo color mode.

A typical raster display system 10 known to those skilled in the art of color graphics is shown in FIG. 1. Display system 10 includes a general-purpose CPU 12 and a special-purpose display processor 16 coupled to the system bus 14. The special-purpose display processor 16 performs graphics functions such as scan conversion and raster operations. Display system 10 includes three memory locations: the system memory 22, which contains the application program, graphics package, and operating system; the display processor memory 18, which contains programs that perform the scan and raster operations; and the frame buffer 20, which contains the displayable image created by the scan conversion and raster operations. The video controller 24 converts data from the frame buffer 20 into R, G, and B analog signals and H and V digital synch pulses. The analog RGB signals control the color and intensity of the CRT beam and resultant displayed pixels on the CRT color monitor 26. The R, G, and B signals represent the intensity of the separate red, green, and blue electron beams guns in the CRT color monitor. The combination of the intensities produced by each gun result in the color of a particular pixel at a particular location. While the RGB color coordinate system is widely used to organize video color data, other color coordinate systems are used as well. The alternative HIS color coordinate system expresses colors as a function of hue, intensity, and saturation. The horizontal and vertical (H and V in FIG. 1) signals are digital synch pulses for triggering the horizontal and vertical analog control circuitry, typically placed within the monitor 26. The horizontal and vertical control circuits sweep the beam across and down to cover the entire screen of monitor 26 at a typical "frame rate" of sixty times a second.

The video controller 24 is shown in further detail in FIG. 2. The video controller essentially consists of a RAMDAC 30 for generating the R, G, and B analog signals, a video timing generator 28 for generating the H and V digital synch pulses at terminals 27 and 29 as well as a video clock 42, and a display refresh address generator 8. The RAMDAC 30 and the video timing generator 28 receive data from the frame buffer through the video bus 25. The display refresh address generator 8 provides a sequence of addresses to the frame buffer 20 on address bus 23 in order that the data is presented to the RAMDAC 30 in the proper display sequence.

The RAMDAC 30 includes a random access memory ("RAM") 32, such as a 256 by 24 RAM (also known as a "color palette") for receiving eight bits of information and generating three eight bit outputs, which are coupled to three digital-to-analog converters ("DACs") 34, 36, and 38. Each DAC converts the digital information from RAM 32 into appropriate analog signals for driving the video inputs of color monitor 26 at terminals 35, 37, and 39, respectively labeled R, G, and B. The outputs of the RAMDAC 30 are typically current outputs, which are converted into analog voltages when coupled to an appropriate load resistor. The RAMDAC 30 can include input latch circuits, input multiplexers, and other circuits for generating additional functions such as text overlay and cursor. An example of a typical RAMDAC circuit is the Bt468 integrated circuit manufactured by Brooktree Corporation of San Diego, Calif.

The RAMDAC 30 is shown in still further detail in FIG.3. In addition to RAM 32 and DACs 34, 36, and 38, RAMDAC 30 typically includes an input shift register 6. At higher operating speeds in the hundreds of megahertz, it is difficult for ordinary TTL type circuits to directly drive the eight bit input of RAM 32. Therefore input shift register 6 converts a sixty-four bit parallel input bus into an eight bit bus that can be used by RAM 32. In this manner, the effective maximum frequency rate of the data presented to RAMDAC 30 is divided by a factor of eight. This lower input frequency is generally within the range of operation of most TTL driver circuits.

Raster scan display systems are typically configured to provide either a "true color" mode or a "pseudo color" mode. The pseudo color mode is best described with reference to FIG. 2. Note that RAM 32 has one data input and three data outputs. The input bus to RAM 32 is typically eight bits wide, which carries an address that specifies the color of the pixel being displayed. The RAM 32 serves as a "color lookup table" or "color palette" wherein the $2^8$ (256) possible addresses are transformed into color choices out of a possible $2^{24}$ (16,777,216) total colors. Therefore, each address location in RAM 32 contains a twenty-four bit data word, which represent the red, green, and blue color components. The pseudo color mode is used in applications where fine gradations in color are necessary, but large numbers of colors are not needed. An example of an image not requiring large numbers of colors is an engineering diagram wherein the images are largely comprised of lines or boxes. The RAM 32 can be continually reprogrammed (only once for each video frame) to provide new color palettes as needed for new colors appropriate to the image being displayed.

In contradistinction to the pseudo color mode, the true color mode typically provides several bits (at least five, typically eight) for each of the red, green, and blue color components to provide fine gradations in all color components. All colors (over sixteen million for twenty-four bit true color) are always available and therefore any pixel in the frame may be assigned any color. True color mode is often required for realistic images having extreme variations in color and intensity.

One RAMDAC circuit for creating true color mode is shown in FIG. 4. Color graphics circuit 40 replaces a single RAMDAC and includes first, second, and third RAMDACs 30A, 30B, and 30C. Each RAMDAC receives eight bits from the video bus 25 for the corresponding red, green, and blue color components. Note that a wider, 192 bit (effectively twenty-four bit at the output of the shift register) parallel bus is required for the true color mode. Each RAMDAC 30A–30C is programmed to transfer the address data directly through the internal RAM to the corresponding DAC. Alternatively, the internal RAM can be programmed to provide "gamma correction", which corrects the nonlinearities in the color monitor 26 with respect to the applied analog video signal, or the internal RAM can be programmed to enhance the contrast of the displayed graphics image, which is sometimes used in medical imaging applications. In any case, each output 35, 37, and 39 carries an analog voltage representing eight bits of color information for driving the respective video input of the color monitor 26. Another way of creating true color mode is similar to the circuit shown in FIG. 3, but each RAMDAC is replaced by a VIDEODAC, which is essentially an input register directly coupled to three high-speed DACs. The VIDEODACs do not provide gamma correction or image enhancement.

One trend in color video graphics is to attempt to increase the resolution of the image displayed on the color monitor 26 for the purpose of increasing the clarity and realism of the displayed image. However, to increase resolution, the number of pixels on the screen of the monitor 26 is increased. Furthermore, the frame rate can be increased from 60 Hz to 70 Hz or even higher frequencies to reduce flicker. Either approach of improving the quality of the displayed image thereby increases the frequency of the video signals provided by the RAMDAC 30. The increased operating speed necessary for increased resolution is applicable to both the true color and pseudo color modes.

The highest speed commercially available RAMDAC circuits, compared to the lower speed counterparts, tend to be more costly, consume more power, and are lacking certain desirable features such as hardware cursors and a self-test mode. These functions, if implemented in external hardware, further increase the cost and complexity of graphics systems based on these high-speed RAMDACs.

Another trend in color video graphics is to combine both the true color and pseudo color modes in one video graphics system. Such a system can easily convert from displaying high resolution line drawing of the pseudo color mode with a limited number of available simultaneous colors to displaying realistic images with the full choice of colors available in the true color mode.

User selectable true color and pseudo color modes are provided by advanced integrated circuits that are typically characterized by one or more of the following undesirable attributes: extremely high pin count, low output operating speed, or high video input data bus frequency that is higher than the operating speed of conventional TTL driver circuitry.

Another approach for providing true color and pseudo color modes uses a novel data compression technique for compressing the normal twenty-four bits of true color data into eight bits for use with a normal RAMDAC. However, since the calculations for the data compression are done in the display processor, operating speed is lowered. In addition, certain pathological cases exists that cannot be compressed with existing techniques.

Furthermore, the problem of combining the two color modes only increases as resolution increases. In addition to the problems mentioned above, the problem of providing data to the RAMDAC becomes even more significant. As the number of pixels increases, the frequency of the input data further increases above that which is possible with commercially available TTL based logic blocks. Therefore, either special circuitry must be used in conjunction with the video bus, increasing cost and complexity, or the input bus be configured to be massively parallel. The parallel bus also increases circuit complexity, since additional input registers, latches, and memory are required to convert the massively parallel input data to serial eight bit data suitable for use with the RAMDAC. In addition, the number of pins required by such a part rapidly increases, which also increases cost and complexity.

Therefore, what is desired is a high speed graphics circuit that can provide both high speed pseudo and true color modes using commercially available parts without special circuitry or requiring a significant increase in cost, power, or a loss of functionality.

SUMMARY OF THE INVENTION

It is therefore a principal object of the present invention to provide a color graphics circuit that can provide both a true color and a pseudo color mode.

It is another object of the present invention to provide a color graphics circuit using low-cost, commercially available color graphics components.

It is another object of the present invention to provide a true color mode in which the data for each of the color components is easily reconfigurable.

It is yet another object of the present invention to provide a high video rate pseudo color mode that is not limited by the output operating speed of a RAMDAC.

It is a feature of the present invention that the capability of the RAMDAC to provide gamma correction and image enhancement is preserved.

According to the present invention, a method and apparatus for generating both a true color and fast pseudo color video signals includes the combination of first and second commercially available RAMDACs. Parallel video data representing the red, blue, and green color components of one or more pixels is provided on a video bus to the inputs of the first and second RAMDACs. A first data portion of the parallel video data is presented to the input of the first RAMDAC, which can represent either a single pixel in the fast pseudo color mode or the most significant pixel data in the true color mode. A second data portion of the parallel video data is presented to the input of the second RAMDAC, which can represent either another single pixel in the fast pseudo color mode or the least significant pixel data in the true color mode. The outputs of the two RAMDACs are combined to provide true color video signals in a first RAM programming mode, and the respective outputs of the two RAMDACs are multiplexed to provide fast pseudo color video signals in a second RAM programming mode.

In the first, true color programming mode, the respective outputs of the first and second RAMDACs are coupled together to form the current outputs for driving the color CRT video input. The RAM of the first RAMDAC is programmed by the user to allocate video data from the first data portion between the DACs according to a first predetermined pattern. The RAM of the second RAMDAC is similarly programmed to allocate video data from the second data portion between the DACs according to a second predetermined pattern. The programming of the first and second RAMs allows a wide range of easily reconfigurable true color modes.

In the second, pseudo color programming mode, the video bus carries data for first and second pixel locations. The RAM of the first RAMDAC is programmed by the user to provide predetermined red, green, and blue color data representing the color of the first pixel. The RAM of the second RAMDAC is programmed to provide predetermined color data representing the color of the second pixel. The output of the second RAMDAC is delayed slightly and multiplexed with the output of the first RAMDAC to provide a high speed pseudo color mode.

The foregoing and other objects, features and advantages of the present invention are more readily apparent from the following detailed description of a preferred embodiment that proceeds with reference to the drawings.

BRIEF DESCRIPTION OF THE DRAWINGS

FIG. 8 is a table containing the switch states of the multiplexers for the pseudo and true color modes.

FIG. 9 is a table showing alternative data partitioning for additional true color modes.

DETAILED DESCRIPTION

Figure 1:
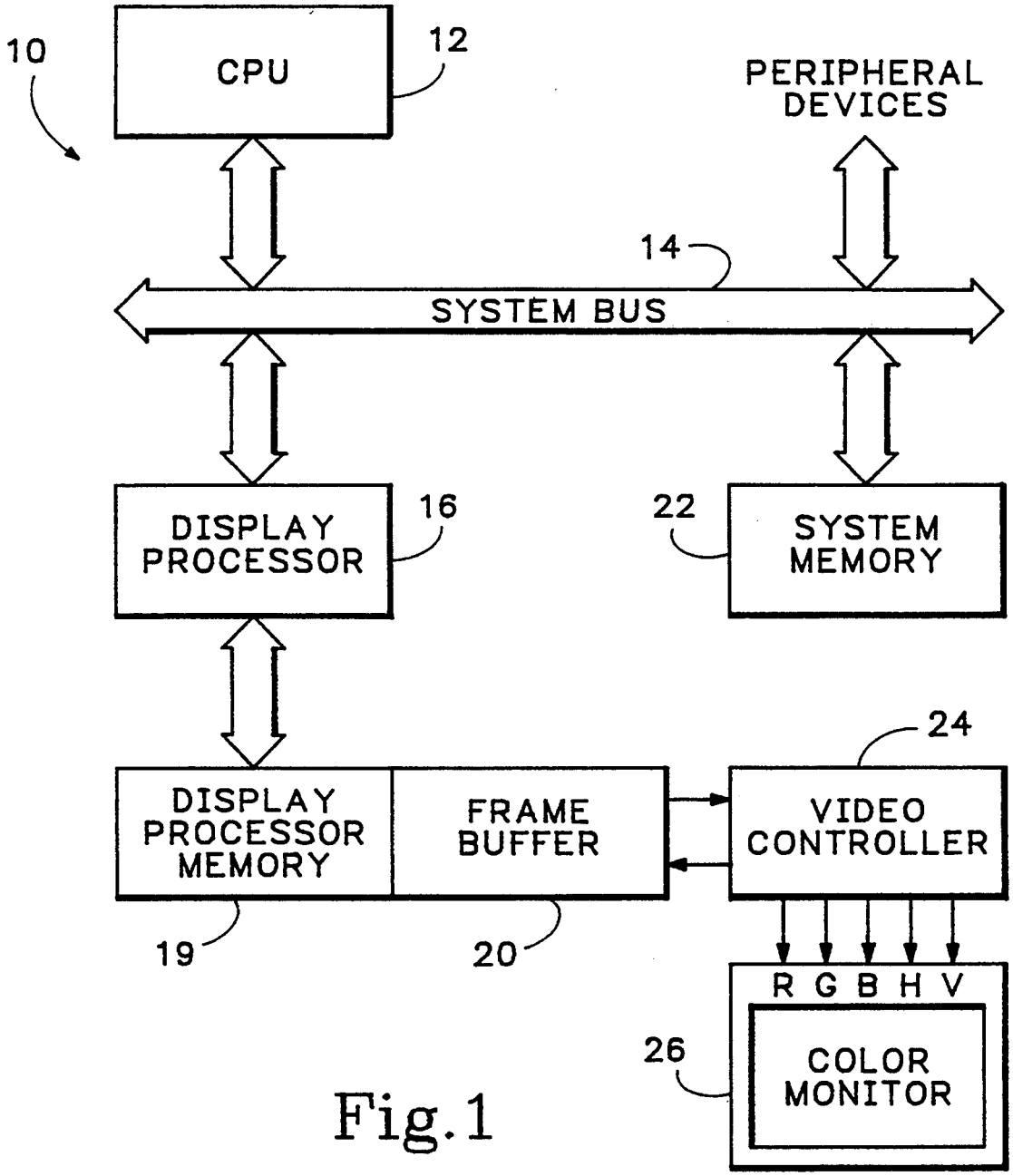
Fig.1 PRIOR ART
FIG. 1 is a block diagram of a typical prior art raster display system.
Figure 2:
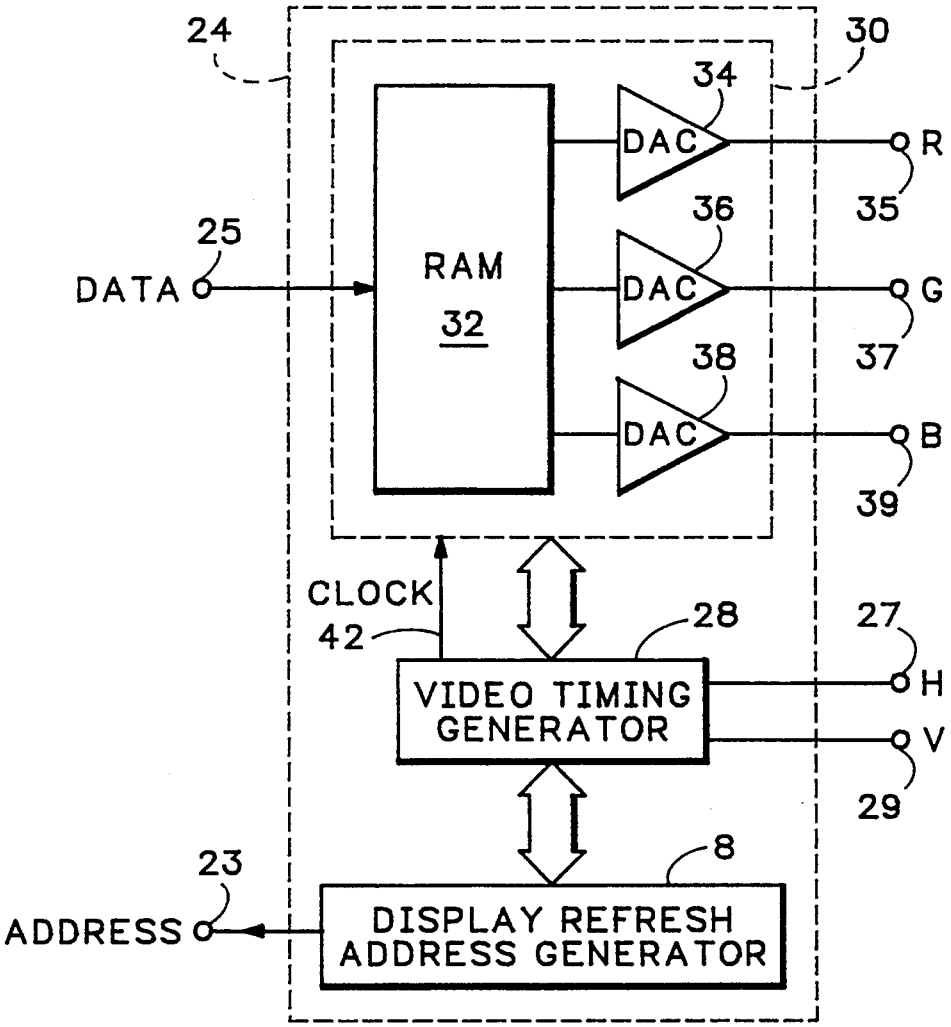
Fig. 2 PRIOR ART
FIG. 2 is a block diagram of a prior art video controller shown in FIG. 1.
Figure 3:
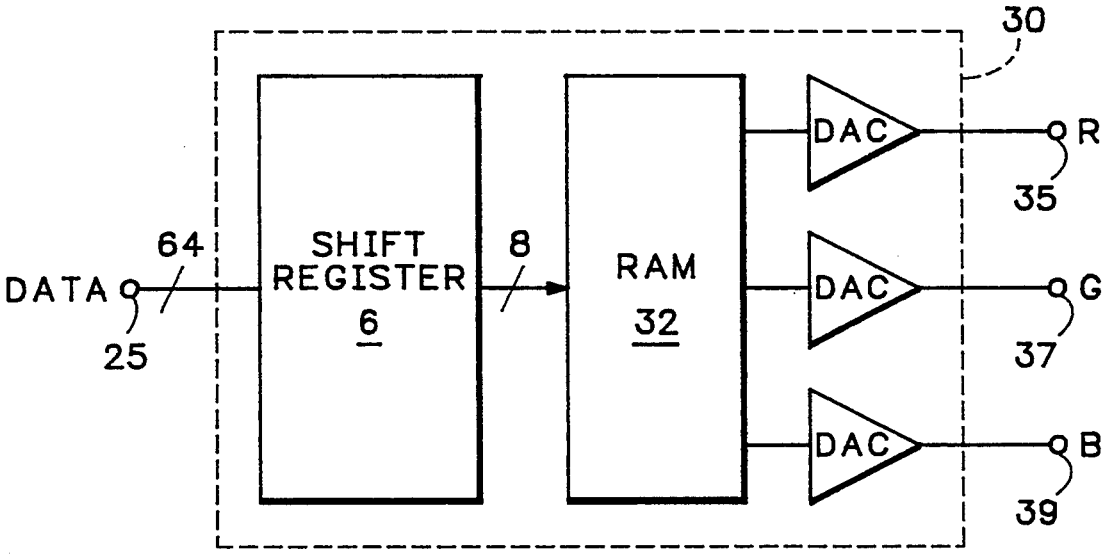
Fig. 3 PRIOR ART
FIG. 3 is a block diagram of a prior art RAMDAC circuit shown in FIG. 2.
Figure 4:
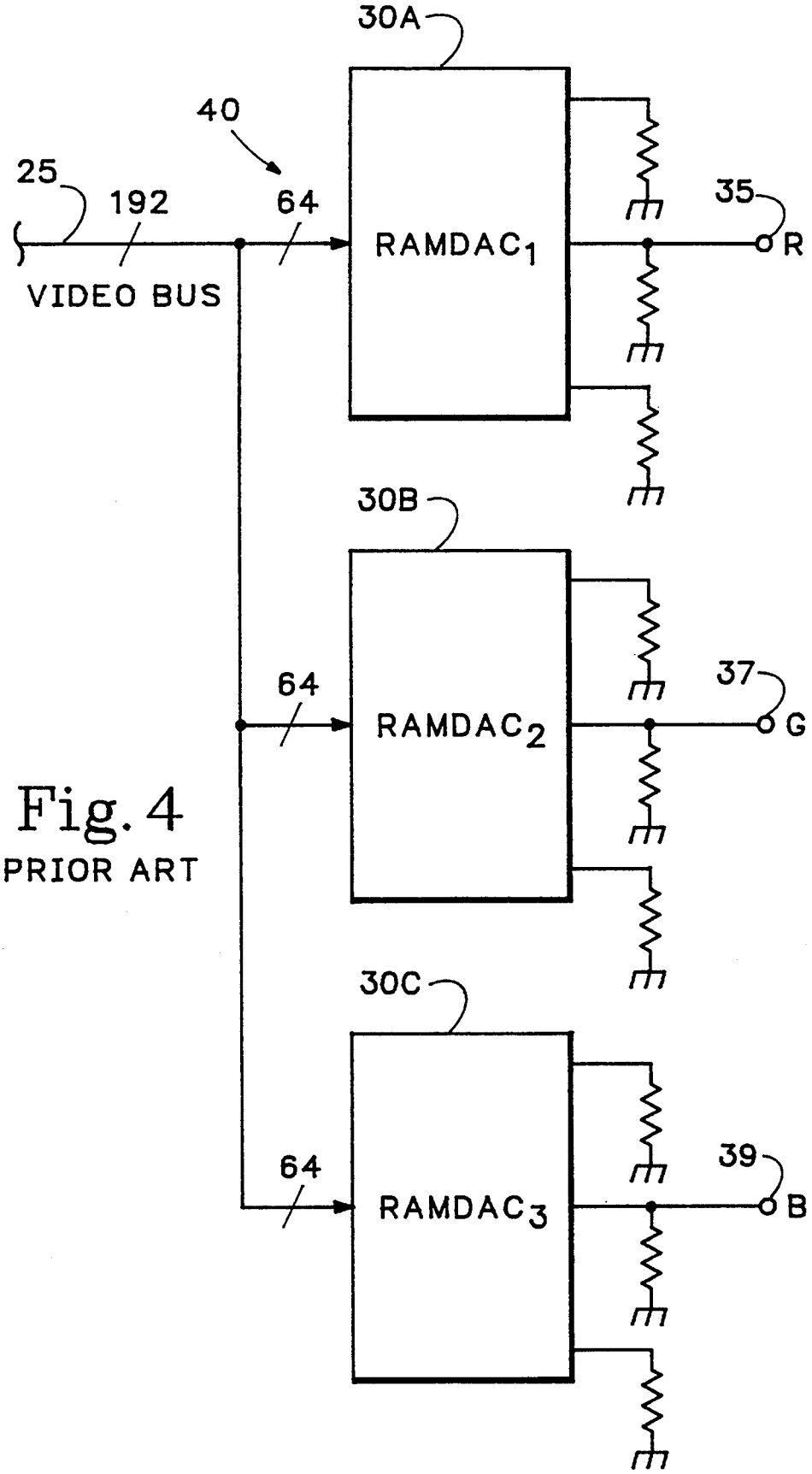
Fig. 4 PRIOR ART
FIG. 4 is a block diagram of a prior art RAMDAC circuit configured to provide a true color mode.
Figure 5:
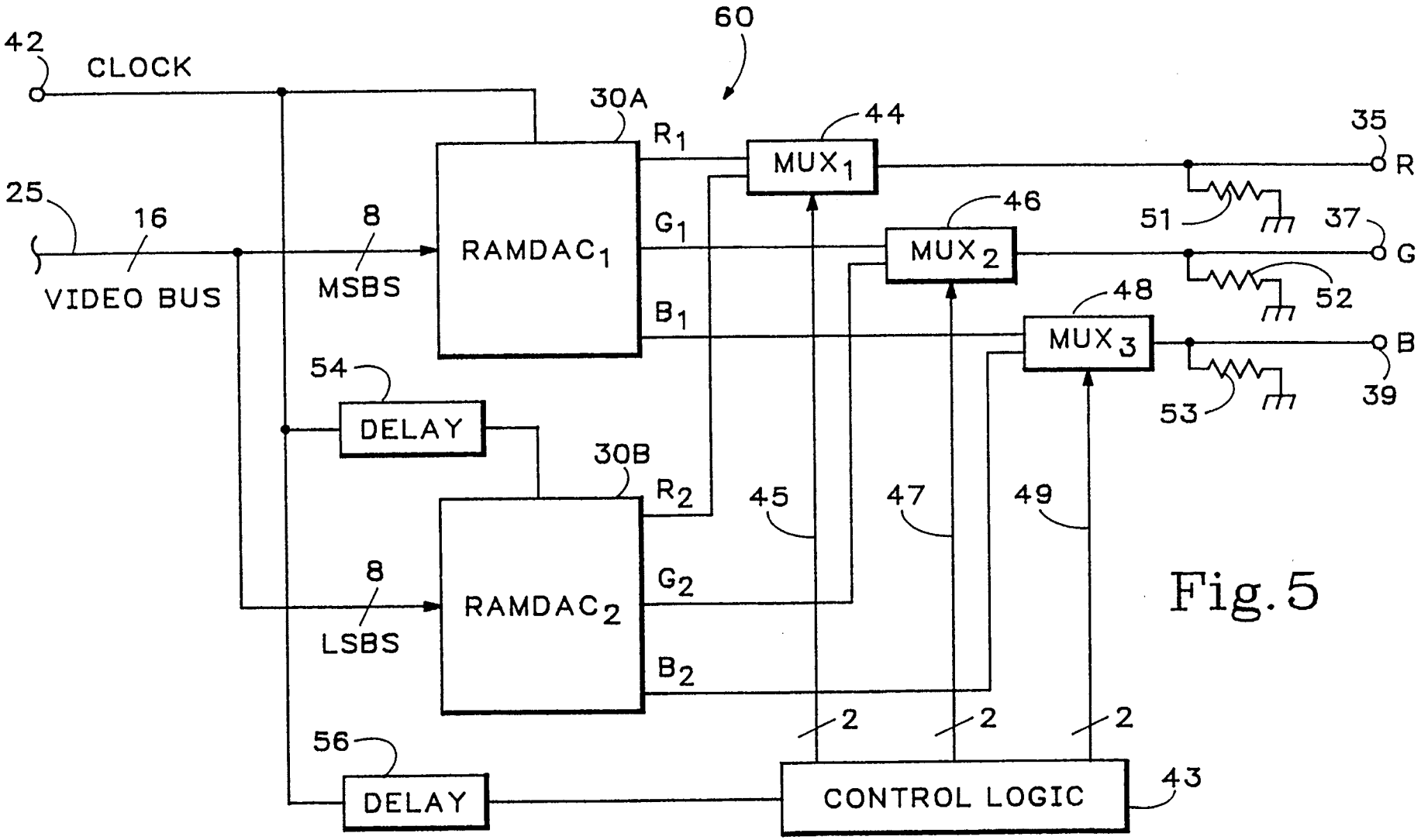
FIG. 5 is a combination block/schematic diagram of a graphics circuit that provides both a true color mode and a fast pseudo color mode according to the present invention.

Referring now to FIG. 5, a color graphics circuit 60 for providing both a true color video mode and a fast pseudo color mode includes an effective sixteen bit parallel video input bus 25 for carrying parallel video data having first and second data portions, the parallel video data representing the color of one or more pixels. For clarity, the input bus 25 in FIG. 5 and subsequent drawing figures is shown as sixteen bits, and the shift register 6 of FIG. 3 is omitted in each RAMDAC. In the preferred embodiment, it is desirable that a full 128 bit input bus 25 be used for maximum operating frequency, wherein sixty-four bits are assigned to each RAMDAC and internally converted to the eight bit data for the RAM.

In the true color mode, the first data portion represents the most significant eight bits of data designated "MSBs", and the second data portion represents the least significant eight bits of data designated "LSBs". First, second, and third current outputs 35, 37, and 39 labeled R, G, and B provide a one volt peak voltage for driving a color CRT video input. Resistors 51, 52, and 53 are typically fifty ohm resistors, which convert the analog current outputs into analog voltage outputs. A first RAMDAC 30A includes a data input coupled to the input bus 25 for receiving the first portion of the parallel video data and three current outputs R1, G1, and B1. A second RAMDAC includes a data input coupled to the input bus 25 for receiving the second portion of the parallel video data and three data outputs R2, G2, and B2. First, second, and third analog switching circuits 44, 46, and 48, designated MUX1, MUX2, and MUX3, have first and second analog inputs, a control digital input, and an analog output. The first input of each analog switching circuit is coupled to the current output of the respective DAC in the first RAMDAC 30A, the second input is coupled to the current output of the respective DAC in the second RAMDAC 30B, and the output coupled to the respective current output of the color graphics circuit. For example, the first input of analog switching circuit 44 is coupled to current output R1, the second input is coupled to current output R2, and the output is coupled to the red output of the graphics circuit 60 on terminal 35. A control logic block 43 including standard logic circuitry is coupled to the digital input of analog switching circuits 44–48. The control logic block has three output busses 45, 47, and 49 to control the switching modes of the analog switching circuits 44–48. A video clock input to the RAMDACs 30A and 30B is provided at terminal 42. (The programming inputs to the RAMDACs and other inputs such as power and ground are not shown for clarity.) Delay elements 54 and 55 are included for proper timing in the multiplexed pseudo color mode, which will be explained in further detail, below. The delay of delay element 54 is approximately one-half of a video clock cycle, and the delay of delay element 56 is variable from zero delay up to the period of the video clock.

Figure 6:
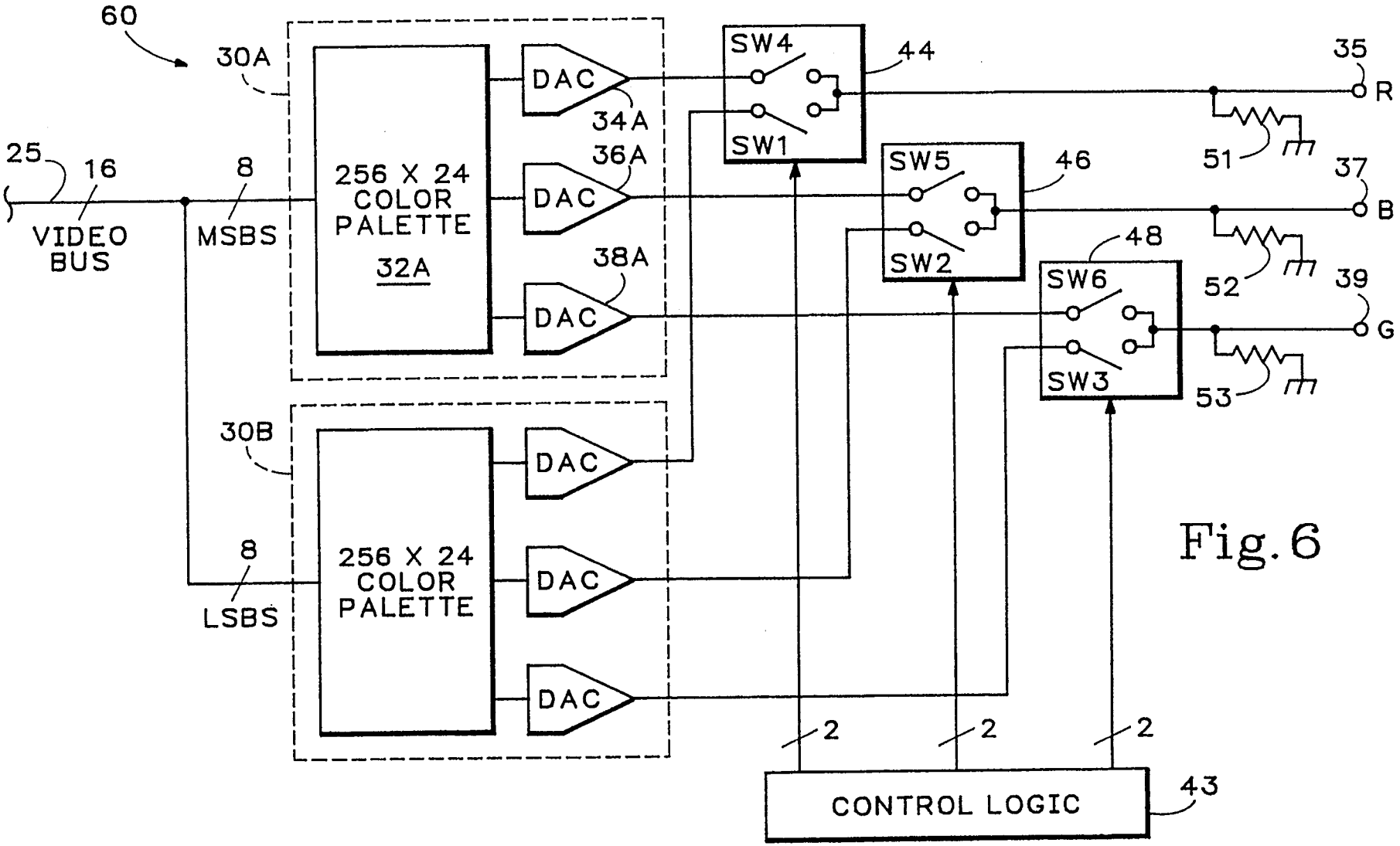
FIG. 6 is in a combination block/schematic diagram showing the analog switching circuits of FIG. 5 in further detail.

The analog switching circuits 44–48 can be seen in further detail in FIG. 6 to include a first switch coupled between the first input and the output and a second switch coupled between the second input and the output. Thus, analog switching circuit 44 includes switches SW1 and SW4, analog switching circuit 46 includes switches SW2 and SW5, and analog switching circuit 48 includes switches SW3 and SW6. The switches, SW1–SW6, are under the control of control logic block 43. Each bit of the output busses is coupled to a single switch to control its state.

The analog switching circuits 44–48 are described below, wherein each analog switching circuit includes dual diode bridges and transformers. However, it is apparent to those skilled in the art that other configurations for a analog switching circuit are possible, without departing from the principles of the present invention. For example, a high performance, bipolar transistor-based multiplexer, if carefully designed, would be capable of multiplexing signals in the hundreds of megahertz range.

Figure 7:
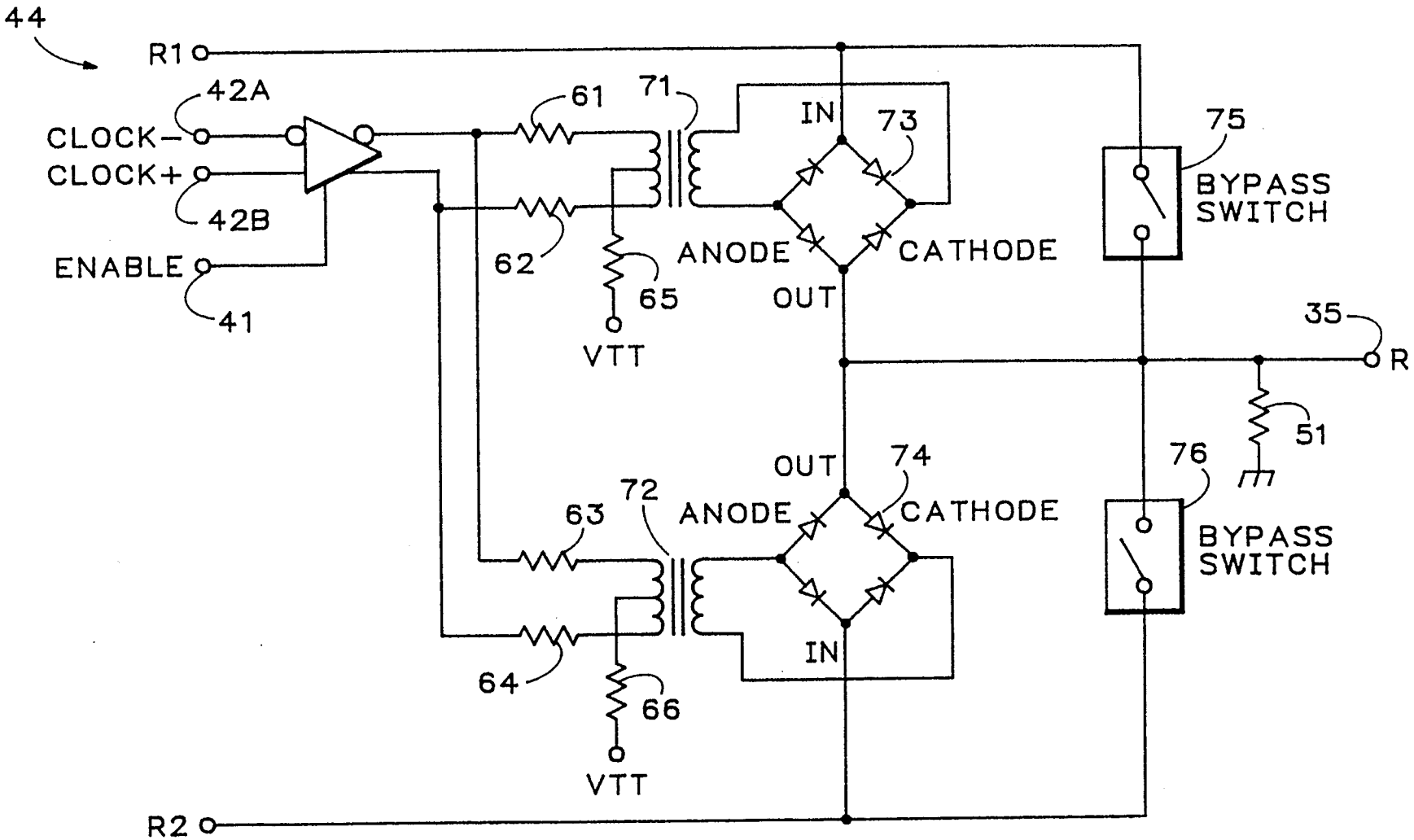
FIG. 7 is a schematic diagram showing one of the analog switching circuits of FIG. 5 is still further detail.

Thus, the schematic diagram of FIG. 7 reveals even further detail of the analog switching circuits 44–48. The schematic of analog switching circuit 44 is shown to include a first diode bridge 73 in parallel connection with a first bypass switch 75 and a second diode bridge 74 in parallel connection with a second bypass switch 76. The combination of diode bridge and high speed switch are desirable to provide the true color mode, and also to provide maximum switching frequency compatible with the high frequency (360 MHz) of the multiplexed pseudo color mode. Bypass switches 75 and 76 are designed to pass high frequency signals in the true color mode, but are not able to switch at the high pseudo color mode frequency. Bypass switches 75 and 76 can either be under software control or can be standalone mechanical switches, depending upon the specific application. A first transformer 71 controls the current flow in the first diode bridge. If the anode of the diode bridge is more positive than the cathode, the diode bridge conducts current from input to output. If the anode of the diode bridge is more negative than the cathode, the diodes are off, and no current flows from input to output. A second transformer 72 controls the current flow in the second diode bridge 74. Buffer amplifier 58 receives a differential video clock at terminals 42A and 42B and provides low impedance opposite-phase clocks to drive the first and second transformers 71 and 72. Resistors 61 through 66 provide balanced loads and termination voltage reference for the buffer amplifier 58. Resistors 61–66 are each desirably equal to twenty-five ohms. The buffer amplifier 58 also includes an enable input at terminal 41 for turning off the clock drive, and thus the low impedance path through diode bridges 73 and 74. In the multiplexing mode, switches 75 and 76 are both open, and the enable input 41 is activated to provide alternate low impedance paths through diode bridges 73 and 74. The first and second analog input signals R1 and R2 are alternatively coupled to the output R at terminal 35.

Referring now to FIG. 8, the switching states of the analog switching circuits are shown to provide the selective combining of the outputs in the true color and pseudo color modes. In the true color more, switch SW1 in analog switching circuit 44 and switch SW6 in analog switching circuit 48 are both off, since RAMDAC 30A does not contribute any green video signal current and RAMDAC 30B does not contribute any red video signal current. Switches SW2–SW5 in analog switching circuits 44–48 are all on to combine output currents and form the true color mode video signal. Note however, that if only the true color mode is desired, the respective outputs of the two RAMDACs 30A and 30B can be hard wired together. If it desirable that the analog switching circuit arrangement of FIG. 11 be used, since the pseudo color mode is also available, but also because any offset currents or other undesired signals at the non-signal contributing RAMDAC outputs are eliminated. In the multiplexing mode, the switch positions are a function of the video clock state. When the video clock 42 (not shown in FIG. 8) is at a logic high level, switches SW1–SW3 are on and switches SW4–SW6 are off, allowing the current outputs from RAMDAC 30B to flow through load resistors 51–53. When the video clock is at a logic high low, switches SW1–SW3 are now off and switches SW4–SW6 are now on, allowing the current outputs from RAMDAC 30A to flow through load resistors 51–53.

In operation, the color graphics circuit 60 has two modes of operation corresponding to the true color and pseudo color switching modes of the multiplexers described above. However, in addition to the switching state of the analog switching circuits 44–48, the RAMs in each RAMDAC 30A and 30B are programmed according to predetermined patterns as is explained in further detail below.

Referring back to FIG. 11, in both modes, the color graphics circuit 60 is provided with parallel video data having first and second data portions on video bus 25. In general, the parallel video data represents the red, blue, and green color components of one sixteen bit pixel in the true color mode, or two eight bit pixels in pseudo color mode. The inputs of the first and second RAMDACs each receives eight bits of the parallel video data.

The outputs of the first RAMDAC 30A are selectively combined i,e., summed, to the respective outputs of the second RAMDAC 30B to provide true color video signals for driving the video input of a CRT color monitor. Note that the order of the red, blue, and green video signals is changed at terminals 35, 37, and 39. The ordering of the outputs, data allocation, and further details of the true color mode operation are explained below.

Figure 11:
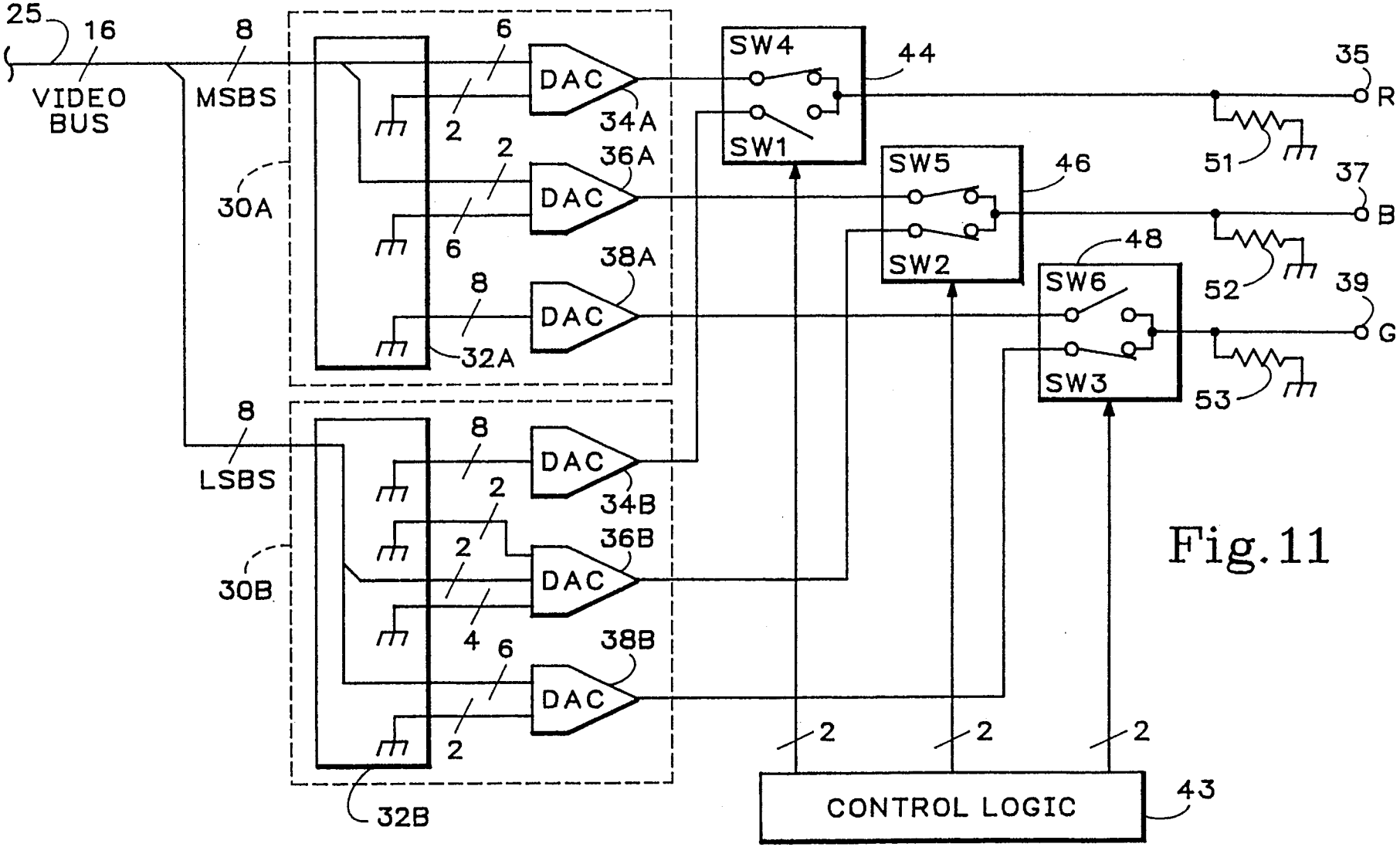
FIG. 11 is a combination block/schematic diagram of the graphics circuit of FIG. 5 configured in the true color mode.

FIG. 11 further shows the programming of RAM 32A of the first RAMDAC 30A to allocate video data from the first data portion between the coupled first, second, and third DACs 34A–38A according to a first predetermined programming pattern. Similarly, FIG. 11 further shows the programming of RAM 32B of the second RAMDAC 30B to allocate video data from the second data portion between the coupled first, second, and third DACs 34B–38B according to a second predetermined programming pattern. The first and second programming patterns are explained further below. (The programming busses, video clock, and other inputs known to those in the art for properly biasing, programming, and operating a RAMDAC are not shown in FIG. 11 for clarity.) Each of the RAMDACs 30A and 30B produce partial video current outputs that, when properly summed, provide a total true color video current. The true color video current is transformed into a true color voltage signal by resistors 51–53 at terminals 35–39.

The video bus 25 contains six bits of red color data, four bits of blue color data, and six bits of green color data (6-4-6 RBG). This is only one example of a true color mode. The data can be partitioned many different ways, with the total number of bits less than or equal to the number of bits on the video bus 25, in this case sixteen. In the example of FIG. 11, the most significant eight bits contains six bits of red data and the two most significant bits of blue color data. The least significant eight bits contains the two least significant bits of blue color data and six bits of green data. The reason the blue data is split between the first and second RAMDACs 30A and 30B is that the human eye is less sensitive to variations in the intensity of the color blue. Although commercially available RAMDACs are usually very well matched, it is desirable to split up the blue data to minimize the effects of any change in gain or offset between RAMDAC 30A and RAMDAC 30B. However, assuming well matched RAMDACs are used, either the red color data or the green color data can be split up between RAMDACs 30A and 30B, if desired. In fact, all data components can be split such that RAMDACs 30A and 30B both receive a portion of the red, green, and blue color data.

Each RAM 32A and 32B in FIG. 11 is programmed to allocate the 6-4-6 RBG color data on the input video bus 25 to the proper DAC. The data allocation in each RAM is shown in further detail in FIG. 10. RAMs 32A and 32B are each shown as three memory sections having the same eight bit input address (the MSBs and LSBs of the color data, respectively), and eight bits of output data.

Figure 10:
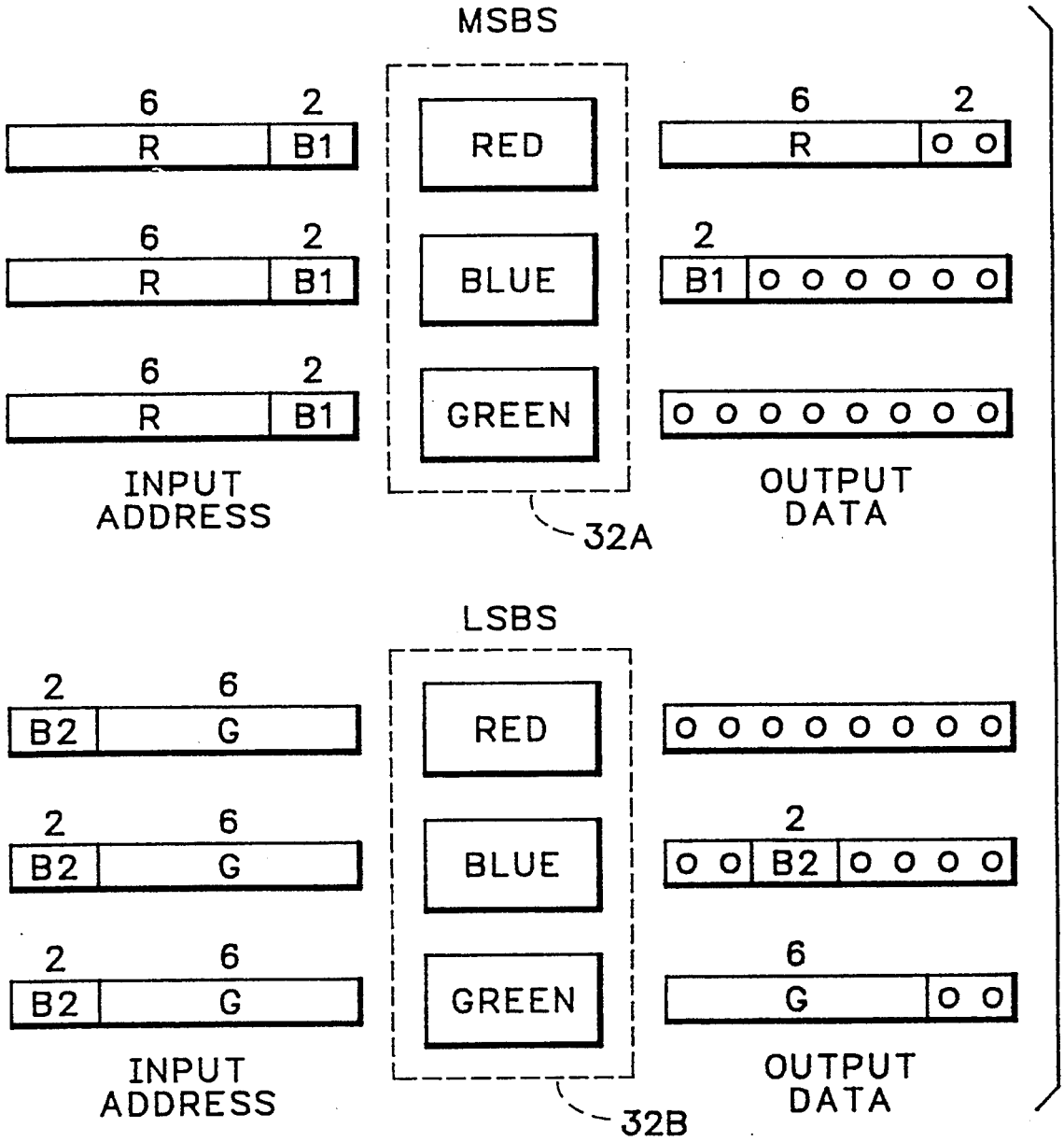
FIG. 10 is a diagram showing the data partitioning of the most significant and least significant bits in each RAMDAC for a sixteen bit input bus configured in a 6-4-6 RBG format.

In the upper portion of FIG. 10, each memory section of RAM 32A receives the same eight bit input address, including six bits of red data, and the two most significant bits of blue data. The "red memory section" is programmed to pass the six bits of red data directly to the most significant six bits of the output data. The two least significant bits of output data are "masked out" i.e., programmed to contain only zeroes. The "blue memory section" is programmed to transfer the least significant two bits of the input address to the most significant two bits of output data. The remaining six bits are programmed to contain zeroes. The "green memory section" is programmed to contain all zeroes, since the entire green color signal will emanate from the second RAMDAC 30B.

In the lower portion of FIG. 10, each memory section of RAM 32A receives the same eight bit input address, including the two least significant bits of blue data and six bits of green data. The "red memory section" is programmed to contain only zeroes since the entire red color component signal has been provided by first RAMDAC. The "blue memory section" is programmed to transfer the two bits of blue data to their proper location on the output data word, which are the third and fourth most significant bits. All other bits of the blue output data are programmed to contain zeroes. Therefore, RAM 32A is programmed to contain the first two bits of the blue data, and RAM 32B is programmed to contain the next two bits of the blue data. The "green memory section" is programmed to assign the green data to the six most significant bits of output data.

It is appreciated by those skilled in the art that the input video data has been properly allocated within each of the RAMS 32A and 32B to pass some, all, or none of the bits of the red, green, and blue video data to DACs 34A–38A, and 34B–38B, in order to generate appropriate red, blue, and green analog video signals. It is further appreciated that the programming of RAMs 32A and 32B is easily reconfigurable to provide a plurality of true color modes. Referring now to FIG. 9, several data allocation maps are provided for partitioning the data. The first partitioning for the red, blue, and green components is 6-4-6 RBG, split into six red bits and two blue bits in the first RAMDAC 30A and two blue bits and six green bits in the second RAMDAC 30B. Other partitionings are possible including: 4-4-8, 5-3-8, 5-4-7, and 5-5-6, among others. The 5-5-6 partitioning, for example, is split into five red bits and three blue bits in the first RAMDAC 30A and two blue bits and six green bits in the second RAMDAC 30B. Equal partitionings of data are possible, whereby all of the sixteen bits are not used. For example, a 5-5-5 RGB data partitioning can include five red bits and three green bits in the first RAMDAC 30A and two green bits and five blue bits in the second RAMDAC 30B. Note that in this data partitioning, the green color data is split between RAMDACs 30A and 30B. The remaining bit is a "don't care" bit and is not used.

In FIGS. 9–11 it is contemplated that a first RAMDAC receives the entire red color component data and a portion of blue or green color data, while a second RAMDAC receives the remaining portion of blue or green color data and the entire green or blue color component data. However, if desired, the video data can be organized to contain red, blue, and green data in both the MSBs and LSBs. For example, 4-4-8 RGB color data can be organized into a 2-1-5 partitioning for the first RAMDAC and 2-3-3 partitioning for the second RAMDAC. The data allocation would proceed as above, wherein each portion of the memory in the respective RAMDACs is organized to assign the correct input address bits to the proper output data word location.

In the second, pseudo color mode, each RAMDAC is used in the conventional manner for creating a twenty-four bit color from an eight bit video input address, as described above. However, the switches in the analog switching circuit are controlled by control logic block 43 to alternatively switch between the respective outputs of the first and second RAMDACs 30A and 30B to provide a fast pseudo color video mode, wherein the operating frequency is approximately double that of a single RAMDAC operating in the pseudo color.

In the multiplexing, high speed pseudo color mode, data is allocated in the first and second data portions to represent first and second adjacent pixel locations on the color monitor. The RAM 32A of the first RAMDAC 30A is programmed to provide predetermined red, green, and blue color data representing the color of the first pixel in response to receiving the first data portion and the RAM 32B of the second RAMDAC 30B is programmed to provide predetermined red, green, and blue color data representing the color of the second pixel in response to receiving the second data portion.

Referring back to FIG. 5, the delay element 54 is ideally set to one-half of the period of a video clock cycle in order that the current at the output of RAMDACs 30A and 30B stabilize before the analog switching circuits 44–48 select the respective current to be passed to the R, G, and B outputs at terminals 35–39. The delay element 56 is continuously variable between zero delay and one video clock period to correct for delays through the control logic 43 and analog switching circuits 44–48 relative to the delay through the RAMDACs 30A and 30B. Delay elements 54 and 56 are disabled in the true color mode.

Figure 12:
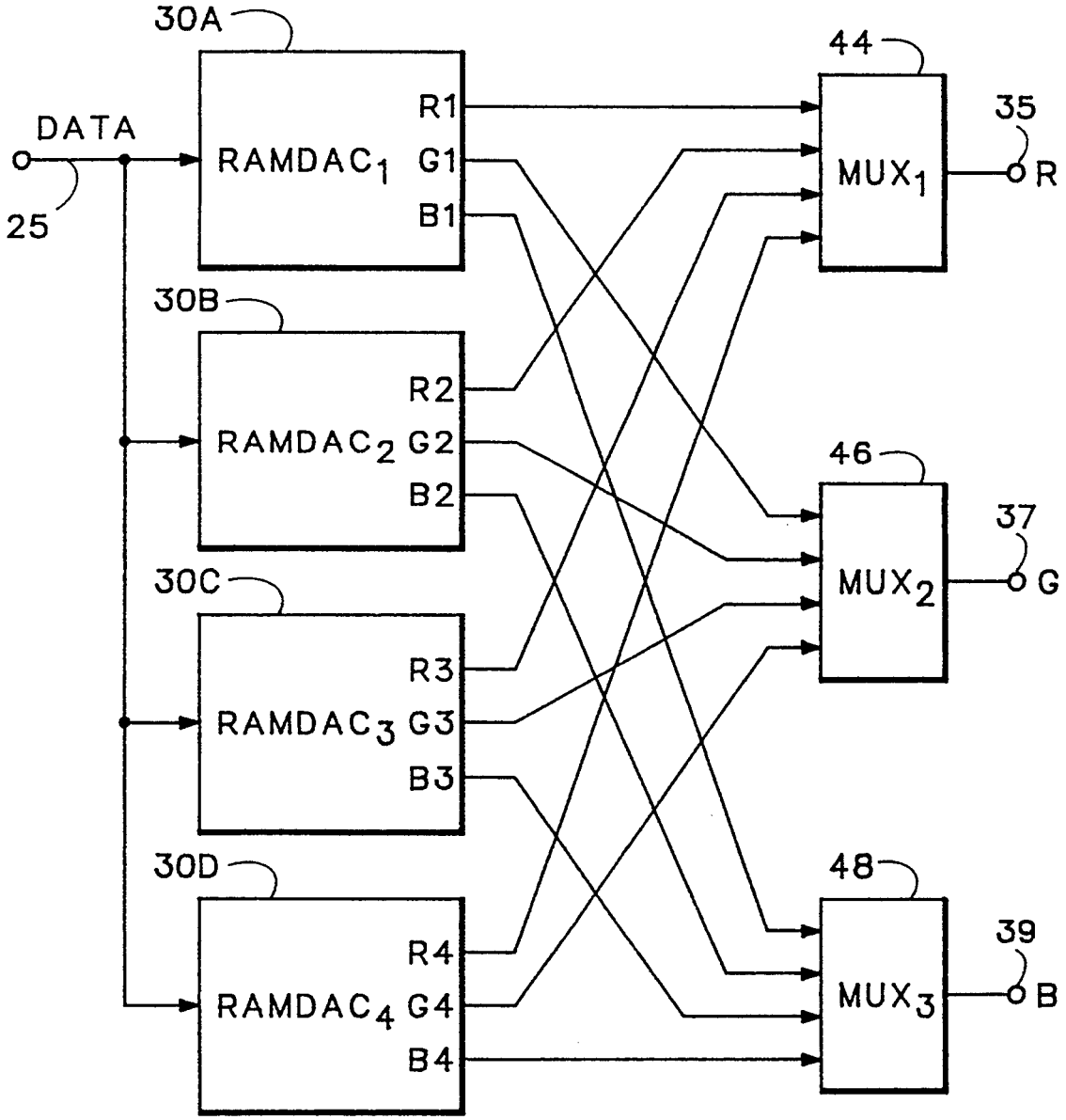
FIG. 12 is a block diagram of an alternative embodiment of the invention including four RAMDACs.

An alternative embodiment of the present invention can contain three or more RAMDACS. An embodiment using four RAMDACs is shown in FIG. 12. Such an embodiment may be required where a sixteen bit true color mode is inadequate, and a twenty-four bit true color is required. In the true color mode, a twenty-four or thirty-two bit input bus contains color data that may be allocated in any fashion according to the principles of the present invention to provide partial analog color signals. The partial color signals are then summed in the analog switching circuits to provide full color signals at terminals 35, 37, and 39. In the pseudo color mode, each RAMDAC receives an adjacent pixel address and is programmed to provide normal pseudo color output data. However, the effective operating speed is increased by a factor of four due to the four inputs to each analog switching circuit. It is desirable to delay the clock to each RAMDAC sequentially by a quarter of a clock cycle. In addition, an adjustable delay is desirably provided to the control logic block (not shown in FIG. 12). The analog switching circuits 44, 46, and 48 can each be fabricated of three analog switching circuits as shown in FIG. 7 in a cascade arrangement, or other designs known in the art to achieve four-to-one multiplexing. However, in the four-RAMDAC embodiment of FIG. 12, a double-frequency video clock is desirable for proper switching of the analog switching circuits.

Having illustrated and described the principles of my invention in a preferred embodiment thereof, it is apparent to those skilled in the art that the invention can be modified in arrangement and detail without departing from such principles. For example, the exact number of bits in the video input and the inputs and outputs of the RAMs in the RAMDACs can be changed to accommodate the specific requirements of a given application. A twenty bit input bus and ten bit RAMDACs could be used instead of the sixteen bit input bus and eight bit RAMDACs shown and described in the preferred embodiment. In addition, the number of RAMDACs used can be two, three, or four, according to the number of bits required for the true color mode, and the desired increase in speed in the pseudo color mode. Further, if an alternative, high speed bipolar multiplexer is used, the entire combination of two or more RAMDACs, analog switching circuits, and control logic can be fabricated onto a single integrated circuit. If desired, the analog switching circuits can be eliminated, and the outputs can be hardwired to provide only a reconfigurable true color mode. Alternatively, the bypass switches can be eliminated to provide only a fast pseudo color mode. We therefore claim all modifications coming within the spirit and scope of the accompanying claims.

We claim:

1. A color graphics circuit for providing a true color mode and a fast pseudo color mode, the circuit comprising:

a parallel video input bus for carrying parallel input video data having a plurality of data portions, the parallel input video data identifying the color of one or more pixels;

at least two RAMDACs, each RAMDAC including a digital input coupled to the input bus, and means responsive to the input data for producing red, green, and blue partial current outputs, wherein each RAMDAC is programmed according to a first predetermined pattern in the true color mode, and a second predetermined pattern in the pseudo color mode;

a first analog switching circuit having a plurality of inputs for receiving each of the red partial current outputs, and an output for providing a red video signal;

a second analog switching circuit having a plurality of inputs for receiving each of the green partial current outputs, and an output for providing a green video signal;

a third analog switching circuit having a plurality of inputs for receiving each of the blue partial current outputs, and an output for providing a blue video signal;

each of the switching circuits having a plurality of switching states including a first state wherein an input signal received on a first input is coupled to the switching circuit output, a second state wherein an input signal received on a second input is coupled to the switching circuit output, and a third state wherein the input signals received on the first and second inputs are summed and then coupled to the switching circuit output; and means for controlling the switching states of the switching circuits.

2. The color graphics circuit of claim 1 in which:

first of said RAMDACs includes a first RAM programmed to allocate output video data from a first data portion of the input video data between the coupled first, second, and third DACs according to a first predetermined pattern, and a second of said RAMDACs includes a second RAM programmed to allocate video output data from a second data portion of the input video data between the coupled first, second, and third DACs according to a second predetermined pattern the parallel input video data identifying the red, blue, and green color components of the pixel, the first data portion comprising a most significant portion of the parallel video data, and the second data portion comprising a least significant portion of the parallel video data.

3. The color graphics circuit of claim 2 in which the input video data identifying the red color component is allocated to the first RAMDAC, the data identifying the blue color component is allocated to the second RAMDAC, and the data identifying the green color component is allocated between the first and second RAMDACs.

4. The color graphics circuit of claim 3 in which the data identifying the red, green, and blue color components each comprise five bits of data.

5. The color graphics circuit of claim 2 in which the data identifying the red color component is allocated to the first RAMDAC, the data identifying the green color component is allocated to the second RAMDAC, and the data identifying the blue color component is allocated between the first and second RAMDACs.

6. The color graphics circuit of claim 2 in which the parallel video data comprises sixteen bits of data, the most and least significant portions of parallel video data each comprise eight bits of data, and the RAMs of the first and second RAMDACs each include an eight bit input and three eight bit outputs.

7. The color graphics circuit of claim 6 in which the most significant portion of parallel video data comprises R bits of red color data and B1 bits of blue color data, and the least significant portion of parallel video data comprises B2 bits of blue data and G bits of green color data, wherein R, B1, B2, and G are integer numbers of bits of the parallel video data such that their sum is equal to sixteen, the RAM of the first RAMDAC being programmed to allocate the R bits of red color data to the first coupled DAC and the B1 bits of blue color data to the second coupled DAC, and the RAM of the second RAMDAC being programmed to allocate the B2 bits of blue color data to the second coupled DAC and the G bits of green color data to the third coupled DAC.

8. The color graphics circuit of claim 7 in which R and G are both equal to six bits, and B1 and B2 are both equal to two bits.

9. The color graphics circuit of claim 7 in which R and B1 are both equal to four bits, B1 is equal to zero, and G is equal to eight bits.

10. The color graphics circuit of claim 7 in which R is equal to five bits, B1 is equal to three bits, B2 is equal to zero bits, and G is equal to eight bits.

11. The color graphics circuit of claim 7 in which R is equal to five bits, B1 is equal to three bits, B2 is equal to one bits, and G is equal to seven bits.

12. The color graphics circuit of claim 7 in which R is equal to five bits, B1 is equal to three bits, B2 is equal to two bits, and G is equal to six bits.

13. A color graphics circuit according to claim 23 in which the means for controlling includes logic control means coupled to the control input of each of the first, second, and third switching circuits for switching between respective current outputs from the RAMDACs in the pseudo color mode;

whereby the graphics circuit can output pseudo color video signals at an operating frequency exceeding a maximum operating frequency of the integrated RAMDACs.

14. A color graphics circuit for providing both a true color video mode and a fast pseudo color mode comprising:

a parallel video input bus for carrying parallel input video data having first and second data portions, the parallel input video data comprising an address for identifying the color of one or more pixels;

first, second, and third current outputs for driving a color CRT video input;

a first RAMDAC including a first RAM having a data input coupled to the input bus for receiving the first portion of the parallel input video data and three output video data outputs, and first, second, and third DACs each having a digital input coupled to one of the RAM data outputs and a current output;

a second RAMDAC including a second RAM having a data input coupled to the input bus for receiving the second portion of the parallel video data and three output video data outputs, and first, second, and third DACs each having a digital input coupled to one of the RAM data outputs and a current output;

first, second, and third analog current switching circuits, each switching circuit having a first input coupled to the current output of the respective DAC in the first RAMDAC, a second input coupled to the current output of the respective DAC in the second RAMDAC, and an output coupled to the respective current output of the color graphics circuit; and means for controlling switching states of the first, second, and third switching circuits, each switching circuit having at least three switching states including a first state wherein an input signal received on the first input is coupled to the switching circuit output, a second state wherein an input signal received on the second input is coupled to the switching circuit output, and a third state wherein the input signals received on the first and second inputs are summed and then coupled to the switching circuit output.

15. A color graphics circuit as in claim 14 in which each of the analog switching circuits comprise:

a first switch coupled between the first input and the output; and a second switch coupled between the second input and the output.

16. A color graphics circuit as in claim 15 in which each of the analog switching circuits further comprise:

a first diode bridge in parallel connection with the first switch; and a second diode bridge in parallel connection with the second switch.

17. A color graphics circuit as in claim 16 in which each of the analog switching circuits further comprise:

a first transformer for controlling current flow in the first diode bridge;

a second transformer for controlling current flow in the second diode bridge; and means for providing opposite-phase clocks to the first and second transformers.

18. A graphics circuit according to claim 14 in which the means for controlling includes logic control means coupled to the control input of the switching circuits for switching alternately between the two DAC current outputs so that the graphics circuit outputs said video signal at an operating frequency exceeding the maximum operating frequency of each of the RAMDACs.

19. A graphics circuit according to claim 18, in which each of the two RAMDACs include a color lookup table having three digital color outputs coupled to first, second and the analog switching circuit includes first second and third current switches each having said two analog current inputs; the first current switch coupled to outputs from the first DACs of both RAMDACs, the second current switch coupled to outputs from the second DACs of both RAMDACs, and the third current switch coupled to outputs from the third DACs of both RAMDACs, so as to provide fast pseudocolor output current signals at an operating frequency exceeding the maximum operating frequency of each of the RAMDACs.

* * * * *

UNITED STATES PATENT AND TRADEMARK OFFICE

CERTIFICATE OF CORRECTION

PATENT NO. : 5,442,379
DATED : Aug. 15, 1995
INVENTOR(S) : Bruce et al.

It is certified that error appears in the above-indentified patent and that said Letters Patent is hereby corrected as shown below:

Column 3, line 54, "exists" should read --exist--;

Column 8, line 2, "receives" should read --receive--;
Column 8, line 4, "i,e" should read --i.e.--;
Column 12, Claim 13, line 62, change "23" to --1--;
Column 14, Claim 19, line 34, "second and the" should read --second and third DACs, and the--.

Signed and Sealed this

Eighth Day of September, 1998

*Attest:*

Bruce Lehman

BRUCE LEHMAN

*Attesting Officer*

*Commissioner of Patents and Trademarks*